US008085903B2

(12) United States Patent
Thomas

(10) Patent No.: US 8,085,903 B2
(45) Date of Patent: Dec. 27, 2011

(54) SHUTTER MECHANISM FOR COLLIMATING X-RAYS

(76) Inventor: Howard C. Thomas, Arvada, CO (US)

( * ) Notice: Subject to any disclaimer, the term of this patent is extended or adjusted under 35 U.S.C. 154(b) by 169 days.

(21) Appl. No.: 12/556,258

(22) Filed: Sep. 9, 2009

(65) Prior Publication Data

US 2010/0061519 A1 Mar. 11, 2010

Related U.S. Application Data

(60) Provisional application No. 61/095,887, filed on Sep. 10, 2008.

(51) Int. Cl.
*G21K 1/04* (2006.01)

(52) U.S. Cl. ..... 378/152; 378/160

(58) Field of Classification Search ..... 378/152, 378/160

See application file for complete search history.

(56) References Cited

U.S. PATENT DOCUMENTS

| | | | | |
|---|---|---|---|---|
| 2,921,202 | A | 1/1960 | Berger et al. | |
| 3,980,407 | A * | 9/1976 | Hill | 355/71 |
| 4,514,859 | A | 4/1985 | Holzermer | |
| 5,396,534 | A | 3/1995 | Thomas | |
| 6,934,363 | B2 | 8/2005 | Seufert | |

* cited by examiner

*Primary Examiner* — Hoon Song
*Assistant Examiner* — Mona M Sanei
(74) *Attorney, Agent, or Firm* — Dorr, Carson & Birney, P.C.

(57) ABSTRACT

A shutter mechanism for collimating x-rays has two parallel drive shafts and two parallel guide shafts orthogonal to the drive shafts to define a rectangular aperture. Two flexible bands moving around a generally rectangular path about the aperture independently control the positions of each set of shutters. Two cams on the drive shafts control the positions of the flexible bands and shutters. A pair of transverse shutters made of an x-ray opaque material are held in sliding engagement between the drive shafts. One end of each transverse shutter is attached to the first flexible band adjacent to the drive shafts. Similarly, a pair of longitudinal shutters are held in sliding engagement between the drive shafts. One end of each longitudinal shutter is attached to the second flexible band adjacent to the guide shafts.

16 Claims, 8 Drawing Sheets

SHUTTER MECHANISM FOR COLLIMATING X-RAYS

RELATED APPLICATION

The present application is based on and claims priority to the Applicant's U.S. Provisional Patent Application 61/095,887, entitled "Shutter Mechanism For Collimating X-Rays," filed on Sep. 10, 2008.

BACKGROUND OF THE INVENTION

Field of the Invention. The present invention relates generally to the field of shutter mechanisms for collimating x-rays. More specifically, the present invention discloses a compact shutter mechanism allowing direct, independent control of two orthogonal sets of shutters.

Shutter mechanisms for x-ray collimators involve a unique set of design requirements. The shutters are typically made of a radio-opaque material, such as lead. This results in shutters that have substantial weight if they are large. In addition, x-ray diagnostic devices used in medical and dental offices are subject to very tight space limitations. Therefore, the shutter mechanism should be compact as possible to meet these space and weight constraints.

In addition, the safety of the patient and healthcare providers is always of paramount concern. This dictates that the shutter mechanism must be capable of a high degree of positional accuracy to ensure an accurate x-ray dosage to the patient through a well-defined aperture, and to prevent accidental exposure of others.

The prior art in the field of shutter mechanisms for collimating x-rays includes the applicant's U.S. Pat. No. 5,396,534 (Thomas). A flexible band extends in sliding engagement about the periphery of an opening in a frame. FIG. 9 of this patent shows an embodiment using two orthogonal pairs of shutters to create an aperture that is adjustable in two dimensions.

SUMMARY OF THE INVENTION

This invention provides a shutter mechanism for collimating x-rays having sets of longitudinal and transverse shutters. Two flexible bands moving around a generally rectangular path about the aperture independently control the positions of each set of shutters. Two drive shafts with cams or pulleys control the positions of the bands and shutters.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
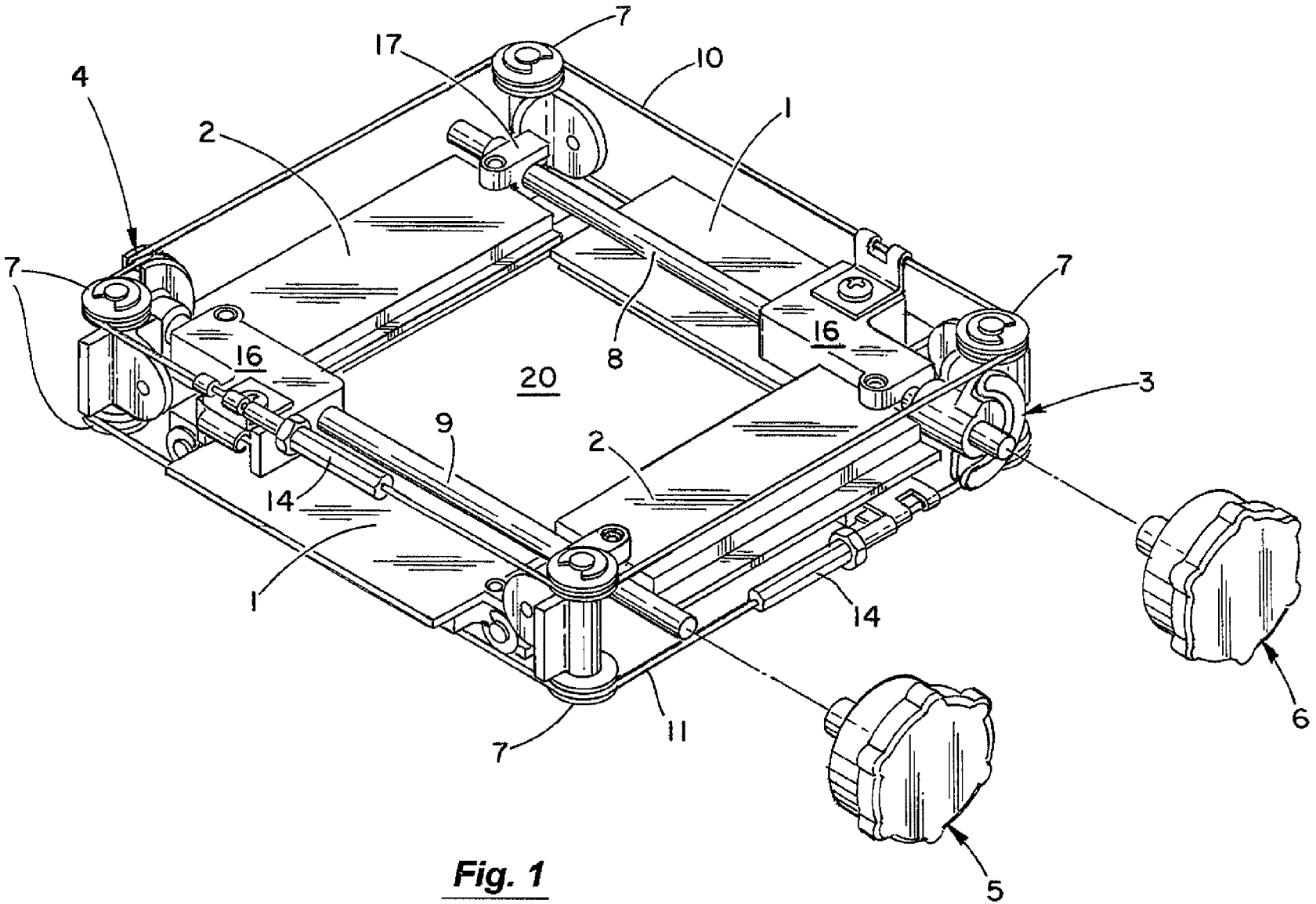
FIG. 1 is a front isometric view of the shutter mechanism with the shutters fully open.
Figure 2:
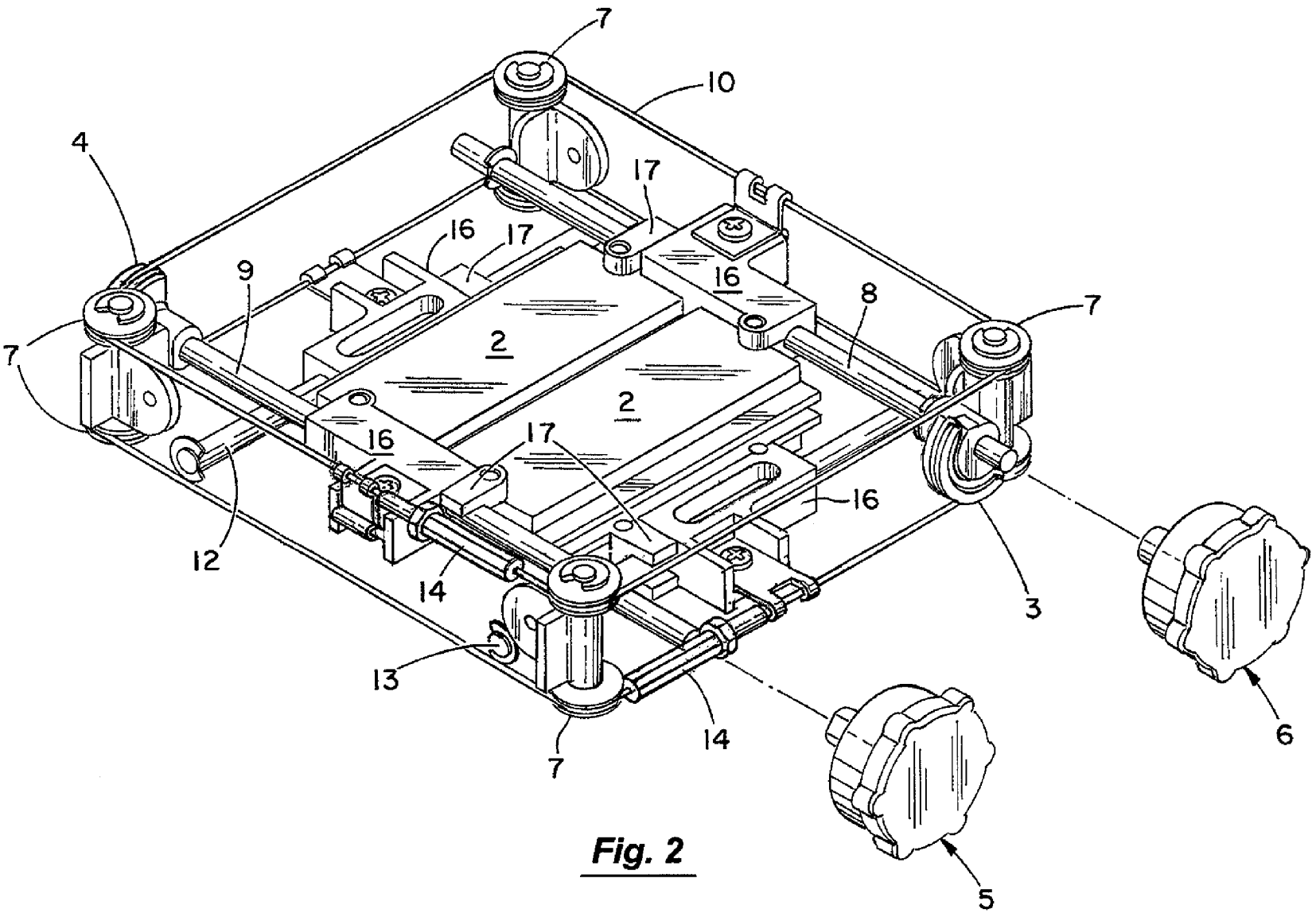
FIG. 2 is a corresponding front isometric view of the shutter mechanism with the shutters fully closed.
Figure 3:
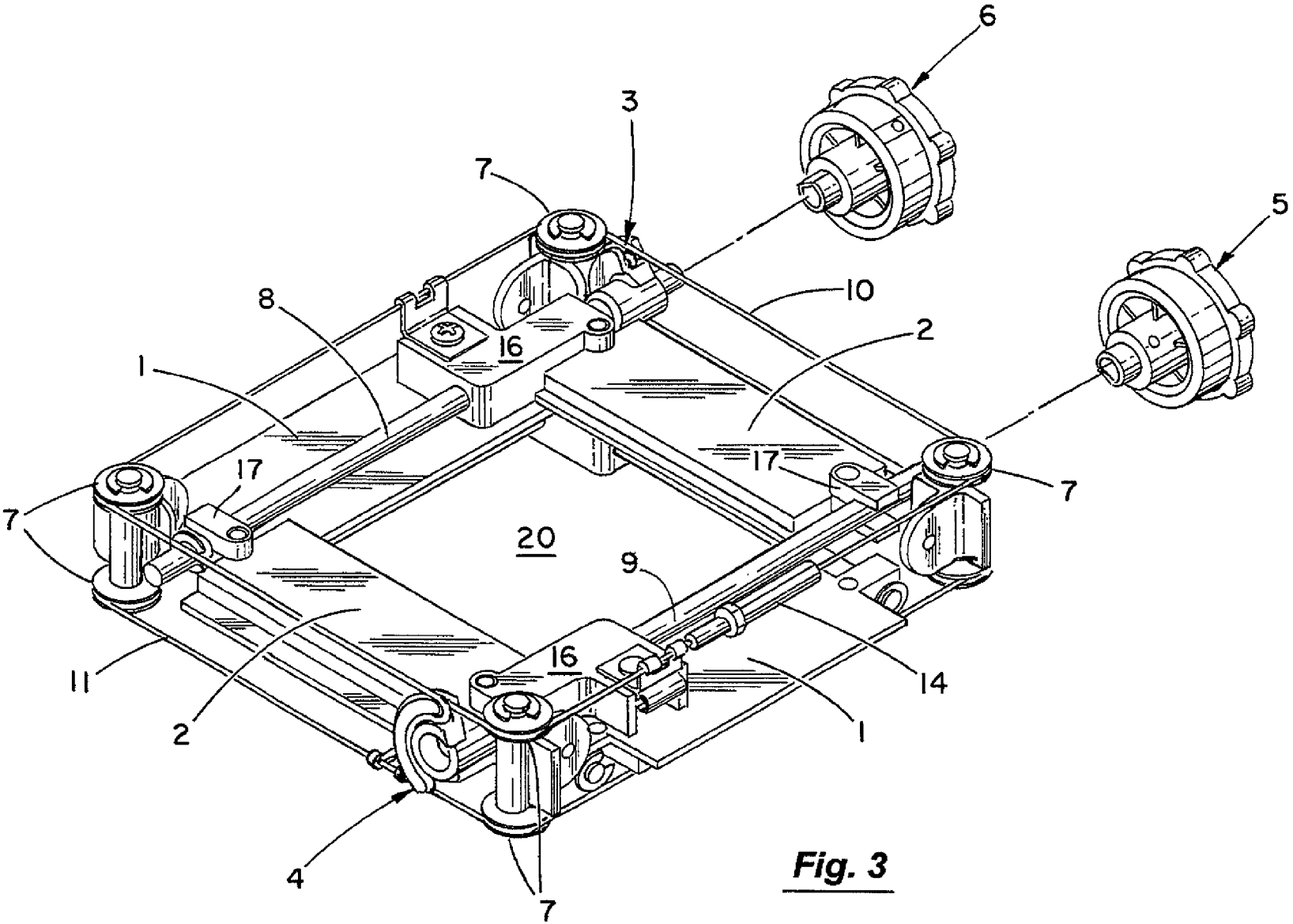
FIG. 3 is a rear isometric view of the shutter mechanism with the shutters fully open.
Figure 4:
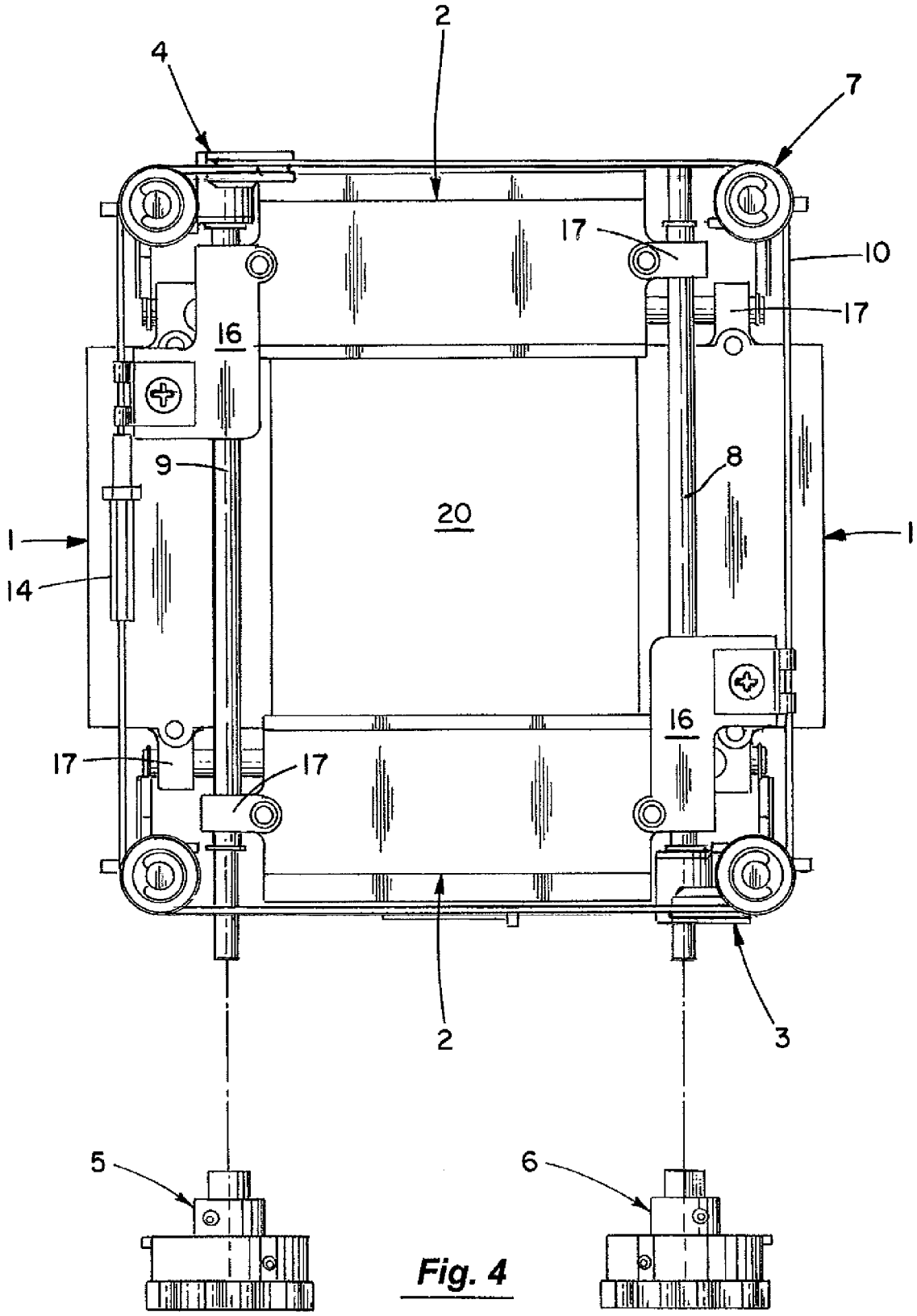
FIG. 4 is a top view of the shutter mechanism with the shutters fully open.

Turning to FIGS. 1 and 2, front isometric views are providing showing the present shutter mechanism with its shutters in the fully open and closed positions, respectively. FIG. 3 is a corresponding rear isometric view and FIG. 4 is a top view of the shutter mechanism with the shutters in the fully open position. In particular, the present invention employs a pair of longitudinal shutters 1 and an orthogonal pair of transverse shutters 2, which define a generally rectangular aperture 20 for the passage of x-rays. For example in FIG. 1, x-rays would pass through the aperture 20 in a generally vertical direction. It should be noted that the present invention is not limited to collimating x-rays. It could also be used for collimating other types of radiation or light.

The shutters 1, 2 are generally planar. The longitudinal shutters 1 are mounted in a common plane, and the transverse shutter 2 are mounted in a common plane parallel to that of the longitudinal shutters 1, but slightly offset to allow the shutters 1, 2 to open and close without mechanical interference. The shutters 1, 2 can be made of plates of a radio-opaque material, such as lead.

Figure 5:
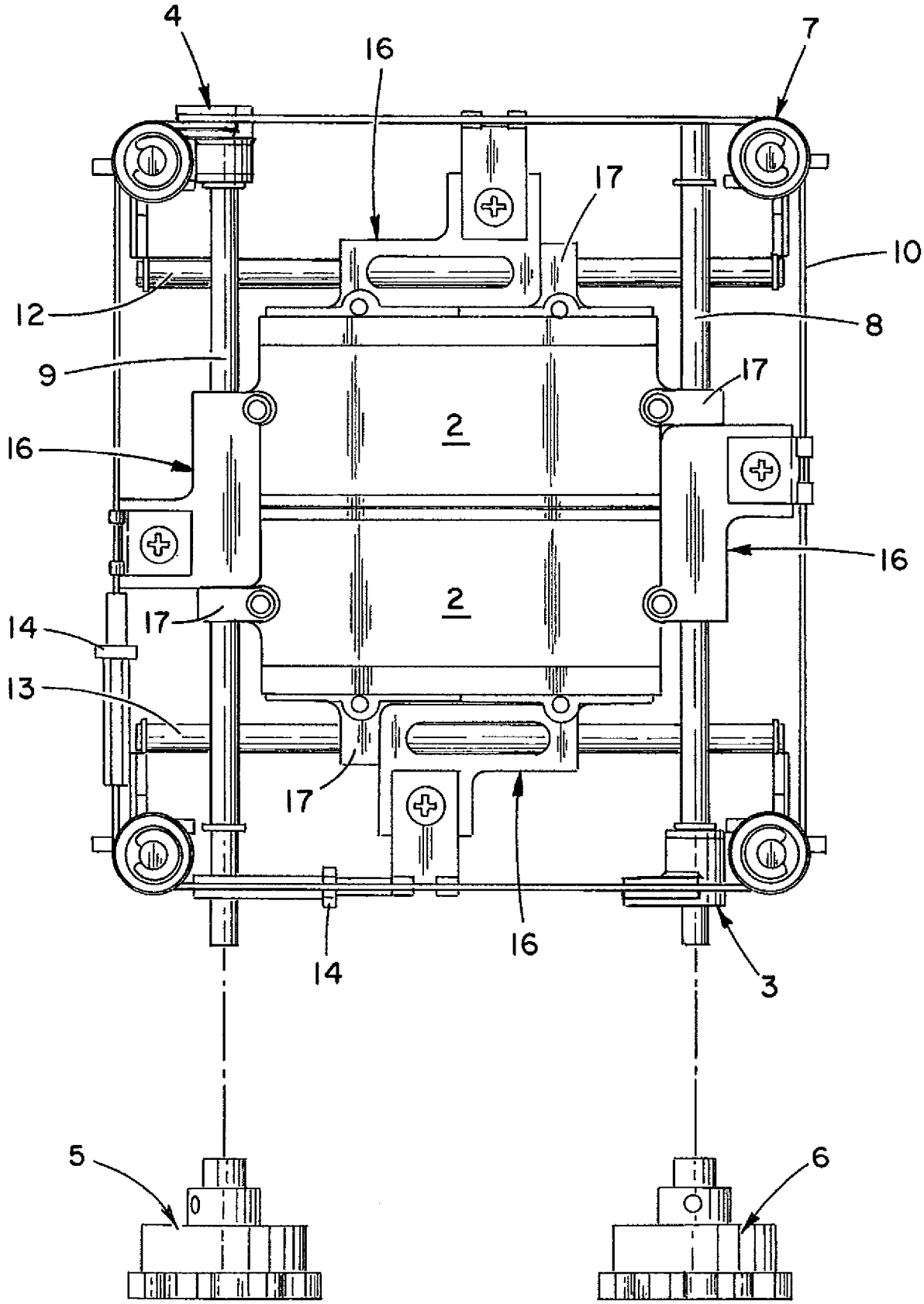
FIG. 5 is a top view of the shutter mechanism with the shutters fully closed.

The shutters 1, 2 are supported by, and slide along two orthogonal pairs of shafts 8, 9 and 12, 13. Of these, one pair of parallel shafts that are spaced apart another are designated as the drive shafts 8 and 9. More specifically, the transverse shutter drive shaft 9 and the longitudinal shutter drive shaft 8 are used to drive the positions of the transverse and longitudinal shutters 2, 1, respectively, as will be discussed below. The other pair of parallel shafts 12, 13 that are space apart from one another are referred to as the guide shafts. The guide shafts 12, 13 are used only for guiding the longitudinal shutters 1. The orthogonal relationship of these pairs of shafts 8, 9 and 12, 13 is shown most clearly in the top view provided in FIG. 5. However, the plane of the guide shafts 12, 13 is slightly offset from the plane of the drive shafts 8, 9 to allow the shutters 1, 2 to operate without mechanical interference. The term "shaft" should be broadly construed to encompass any type of elongated member, regardless of its cross-sectional shape.

The positions of the shutters 1, 2 are separately controlled by rotating the drive shafts 8, 9. Knobs 5 and 6 can be attached to the ends of the drive shafts 8, 9 to simplify manual adjustment of the drive shafts 8, 9 and to provide visual indicators of the shutter positions.

Two flexible bands 10, 11 extend around the perimeter of the shutter mechanism along generally rectangular paths. Alternatively, the flexible bands 10, 11 could be configured to follow other path shapes. The bands 10, 11 are also spaced apart vertically (i.e., along the axis of the x-rays) from one another. In other words, these flexible bands 10, 11 are typically parallel to, but spaced apart from one another in planes that are orthogonal to the axis of x-rays passing through the collimator. Cables, wires, strings, belts or other types of flexible members could be used as the bands 10, 11. Four guide wheels or pulleys 7 on the outer corners of the shutter mechanism allow the bands 10, 11 to freely slide about their respective paths. Fixed guides or tracks could also be used at the outer corners of the shutter mechanisms in place of wheels or pulleys.

In the embodiment shown in the accompanying drawings, the upper band 10 is employed to move the transverse shutters 2 (as will be described below), and can be referred to as the transverse band 10. Similarly, the lower band 11 moves the longitudinal shutters 1, and can be referred to as the longitudinal band 11. The rectangular path of each flexible band 10, 11 has two opposing edges adjacent and parallel to two of the shafts 8, 9 and 12, 13. More specifically, the opposing edges of the transverse band 10 are adjacent and parallel to the drive shafts 8, 9, while the opposing edges of the longitudinal band 11 are adjacent and parallel to the guide shafts 12, 13. The length and tension of the bands 10, 11 can be adjusted by screw adjustment mechanisms 14 or tensioned by springs.

Figure 6:
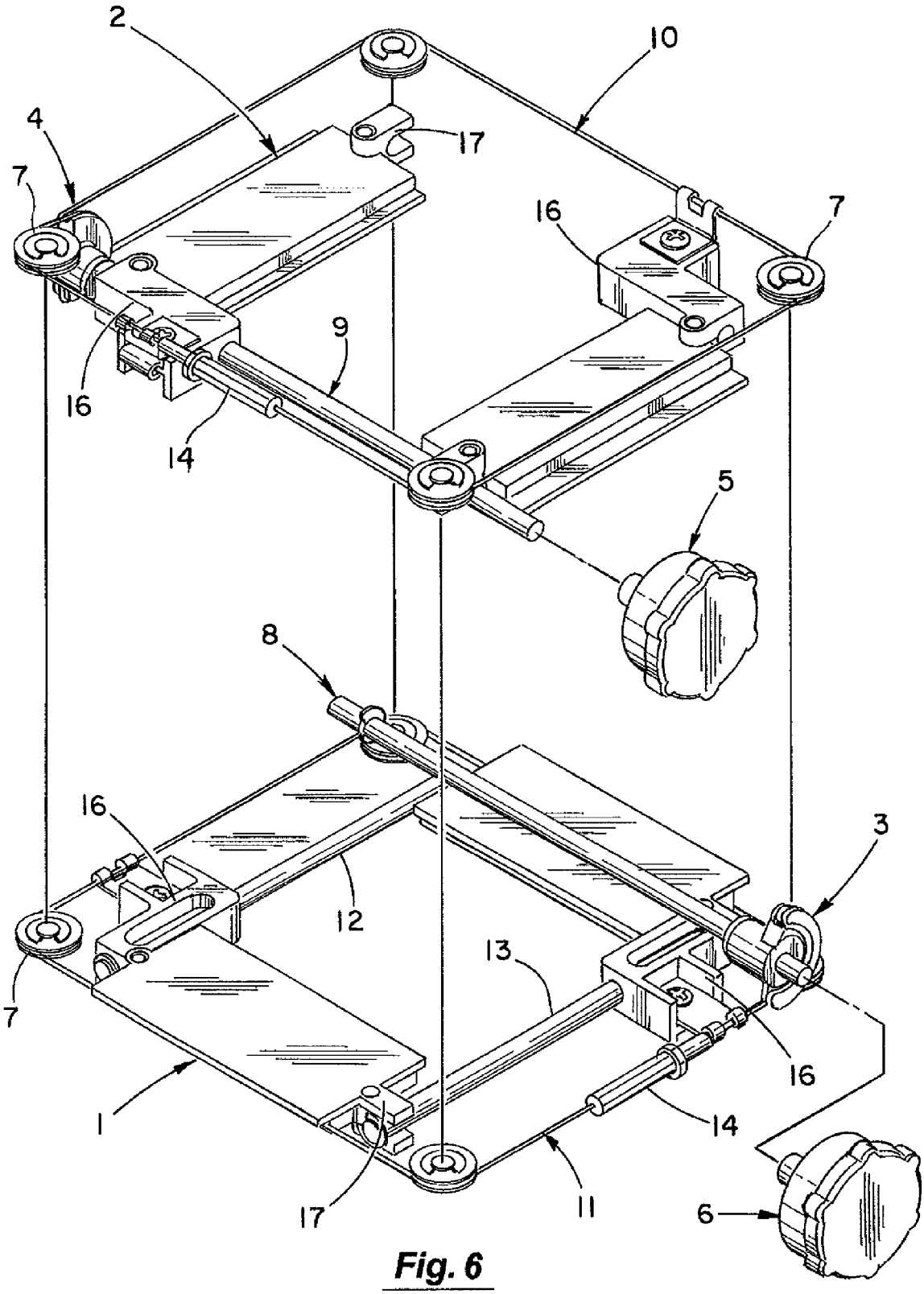
FIG. 6 is an exploded front isometric view of the shutter mechanism with the transverse shutter mechanism separated from the longitudinal shutter mechanism.

Drive cams or pulleys 3, 4 can be mounted on each of the drive shafts 8, 9 to drive the bands 11, 10. For the purposes of this application, the terms "cam" or "pulley" should be broadly construed to include any type of rotational device allowing a shaft to drive or control the position of a flexible band. In the embodiment shown in the figures, the transverse drive cam 4 is mounted on the rear end of the transverse drive shaft 9, so that the transverse drive cam 4 is aligned with the transverse band 10 along the rear edge of its rectangular path. As shown in FIG. 6, rotation of the transverse drive shaft 9 rotates the transverse drive cam 4, which in turn drives the transverse band 10 to translate about its rectangular path either in a clockwise or counter-clockwise direction, depending on the direction of rotation of the transverse drive shaft 9.

In contrast, the longitudinal drive cam 3 is mounted at the front end of the longitudinal drive shaft 8, so that the longitudinal drive cam 3 is aligned with the longitudinal band 11 along the front edge of its rectangular path, as shown in FIG. 6. Rotation of the longitudinal drive shaft 8 rotates the longitudinal drive cam 3, which in turn drives the longitudinal band 11 to translate about its rectangular path. It should be noted that the direction of motion of the longitudinal band 11 will be opposite of that for the transverse band 10 because the longitudinal drive cam 3 and transverse drive cam 4 are on opposite sides of the rectangular paths of their respective bands 11 and 10. These drive cams 3, 4 could be placed on the same side of the shutter mechanism so that the bands 11, 10 would be driven in the same direction by rotation of their respective drive shafts 8, 9. Alternatively, the drive cams 3, 4 could be rotatably mounted to other portions of the frame or support structure of the shutter mechanism, other than the drive shafts 8, 9.

The longitudinal shutters 1 are attached to longitudinal band 11 along the front and rear edges of its rectangular path (i.e., adjacent and parallel to the guide shafts 12, 13). Similarly, the transverse shutters 2 are attached to the transverse band 10 along the two lateral edges of the transverse band 10 (i.e., adjacent and parallel to the drive shafts 8, 9). More specifically, a shutter attachment 16 is secured to one lateral edge of each shutter 1, 2. This shutter attachment 16 includes a clip that is secured to one of the flexible bands 10 or 11 and causes the shutter attachment 16 and shutter 1, 2 to slide with movement of the band 10, 11. The shutter attachments 16 for the longitudinal shutters 1 are attached to the opposing front and rear edges of the rectangular path of the longitudinal band 11. This causes the longitudinal shutters 1 to move in opposing directions as the longitudinal band 11 moves, thereby either opening or closing the longitudinal shutters 1. Similarly, the shutter attachments 16 for the transverse shutters 2 are attached to the opposing lateral edges of the rectangular path of the transverse band 10. This also causes the transverse shutters 2 to move in opposing directions as the transverse band 10 moves, thereby either opening or closing the transverse shutters 2.

Each shutter attachment 16 also has a horizontal channel or hole that slides along at least one of the drive shafts 3, 4 or guide shafts 12, 13 to maintain proper alignment of the shutter 1, 2 with respect to the remainder of the shutter mechanism. For the purposes of this application, the term "channel" should be broadly interpreted to include any type of channel, hole, track or sliding mechanism that allows a shutter to slide along a shaft. The channels in the shutter attachments 16 for the longitudinal shutters I slide along the guide shafts 12 and 13. The channels in the shutter attachments 16 for the transverse shutters 2 slide along the drive shafts 7 and 8.

Each shutter 1, 2 is also equipped with a slider 17 on its other lateral edge opposite from the shutter attachment 16. This slider 17 has a U-shaped channel that receives one of the drive shafts 3, 4 or guide shafts 12, 13. Each shutter 1, 2 is supported between a shutter attachment 16 on one side, and a slider 17 on the other side, which both slide along a pair of parallel shafts 3, 4 or 12, 13. In other words, each shutter 1, 2 is suspended from, and slides along a pair of parallel shafts 3, 4 or 12, 13. The longitudinal shutters 1 slide along the guide shafts 12 and 13, and the transverse shutters 2 slide along the drive shafts 3 and 4.

Figure 7:
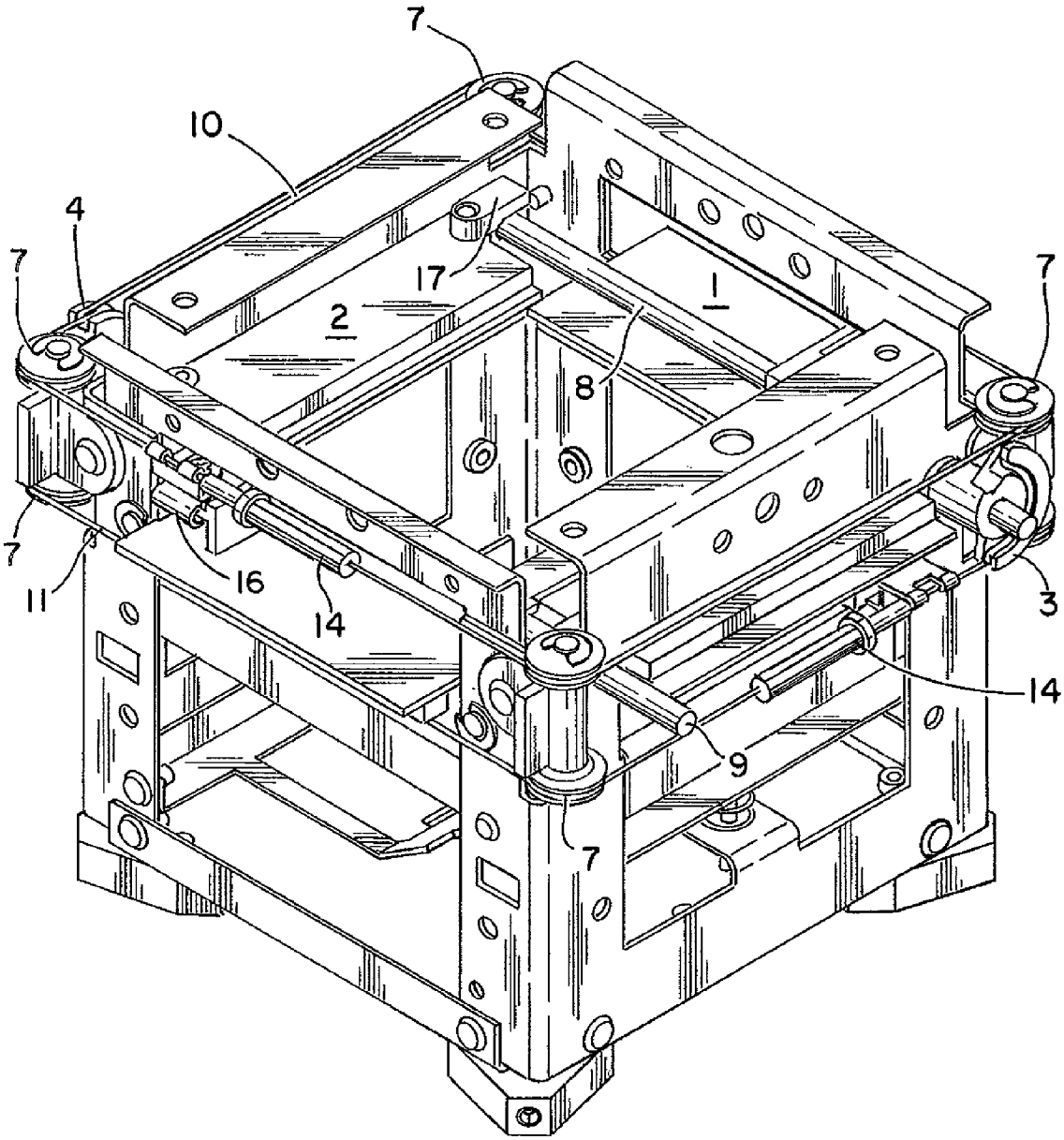
FIG. 7 is a front isometric view of the shutter mechanism with its support frame.
Figure 8:
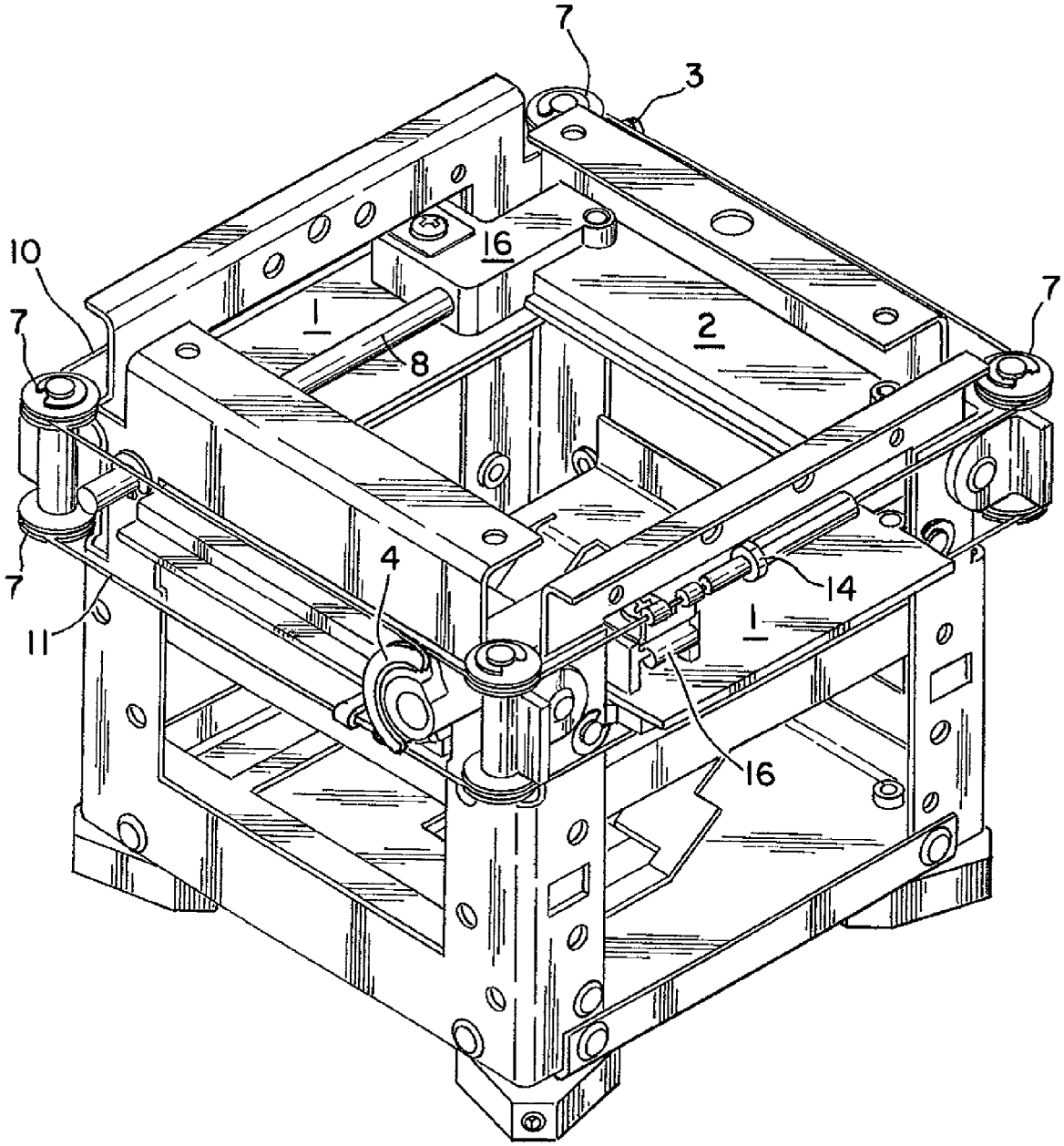
FIG. 8 is a corresponding rear isometric view of the shutter mechanism and support frame.

Finally, a frame or support structure would usually be necessary to support the components discussed above. FIGS. 7 and 8 show front and rear isometric views of the shutter mechanism including one possible type of support structure. It should be understood that other types of support structures could be readily substituted.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

I claim:

1. A shutter mechanism for collimating x-rays comprising:

first and second parallel drive shafts spaced apart from one another;

first and second parallel guide shafts spaced apart from one another, said drive shafts and guide shafts defining an aperture, with the axes of the drive shafts and guide shafts extending parallel to the edges of the aperture;

a flexible transverse band sliding about the aperture with opposing first and second edges moving parallel to the axes of the drive shafts;

a flexible longitudinal band sliding about the aperture with opposing first and second edges moving parallel to the axes of the guide shafts;

a first cam driving the transverse band about the aperture;

a second cam driving the longitudinal band about the aperture;

a first transverse shutter made of an x-ray opaque material having a first end attached to the first edge of the transverse band and held in sliding engagement between the drive shafts to slide along the axes of the drive shafts;

a second transverse shutter made of an x-ray opaque material having a first end attached to the second edge of the transverse band and held in sliding engagement between the drive shafts to slide along the axes of the drive shafts;

a first longitudinal shutter made of an x-ray opaque material having a first end attached to the first edge of the longitudinal band and held in sliding engagement between the guide shafts to slide along the axes of the guide shafts; and a second longitudinal shutter made of an x-ray opaque material having a first end attached to the second edge of the longitudinal band and held in sliding engagement between the guide shafts to slide along the axes of the guide shafts.

2. The shutter mechanism of claim 1 wherein the cams are on the drive shafts.

3. The shutter mechanism of claim 1 wherein the transverse band slides about the aperture in a substantially rectangular path.

4. The shutter mechanism of claim 1 wherein the longitudinal band slides about the aperture in a substantially rectangular path.

5. The shutter mechanism of claim 1 wherein at least one of the shutters further comprises a shutter attachment extending from the first end of the shutter for attachment to one of the flexible bands.

6. The shutter mechanism of claim 5 wherein said shutter attachment further comprises a channel for sliding engagement with one of the drive shafts and the guide shafts.

7. The shutter mechanism of claim 1 wherein the guide shafts are orthogonal to the drive shafts to define said aperture.

8. A shutter mechanism for collimating x-rays comprising:

first and second parallel drive shafts spaced apart from one another;

first and second parallel guide shafts spaced apart from one another and orthogonal to said drive shafts, said drive shafts and guide shafts defining a rectangular aperture, with the axes of the drive shafts and guide shafts extending parallel to the edges of the aperture;

a flexible transverse band sliding about the aperture with opposing first and second edges moving parallel to the axes of the drive shafts;

a flexible longitudinal band sliding about the aperture with opposing first and second edges moving parallel to the axes of the guide shafts;

a first cam on the first drive shaft driving the transverse band about the aperture in a substantially rectangular path;

a second cam on the second drive shaft driving the longitudinal band about the aperture in a substantially rectangular path;

a first transverse shutter made of an x-ray opaque material having a first end attached to the first edge of the transverse band and held in sliding engagement between the drive shafts to slide along the axes of the drive shafts;

a second transverse shutter made of an x-ray opaque material having a first end attached to the second edge of the transverse band and held in sliding engagement between the drive shafts to slide along the axes of the drive shafts;

a first longitudinal shutter made of an x-ray opaque material having a first end attached to the first edge of the longitudinal band and held in sliding engagement between the guide shafts to slide along the axes of the guide shafts; and a second longitudinal shutter made of an x-ray opaque material having a first end attached to the second edge of the longitudinal band and held in sliding engagement between the guide shafts to slide along the axes of the guide shafts.

9. The shutter mechanism of claim 8 wherein at least one of the shutters further comprises a shutter attachment extending from the first end of the shutter for attachment to one of the flexible bands.

10. The shutter mechanism of claim 9 wherein said shutter attachment further comprises a channel for sliding engagement with one of the drive shafts and the guide shafts.

11. A shutter mechanism for collimating x-rays comprising:

first and second parallel drive shafts spaced apart from one another;

first and second parallel guide shafts spaced apart from one another, said drive shafts and guide shafts defining an aperture, with the axes of the drive shafts and guide shafts extending parallel to the edges of the aperture;

a flexible transverse band sliding about the aperture with opposing edges moving parallel to the axes of the drive shafts;

a flexible longitudinal band sliding about the aperture with opposing edges moving parallel to the axes of the guide shafts;

a first cam driving the transverse band about the aperture;

a second cam driving the longitudinal band about the aperture;

a pair of transverse shutters made of an x-ray opaque material held in sliding engagement between the drive shafts to slide along the axes of the drive shafts, each transverse shutter having a shutter attachment extending from a first end of the transverse shutter for attachment to opposing edges of the transverse band; and a pair of longitudinal shutters made of an x-ray opaque material held in sliding engagement between the guide shafts to slide along the axes of the guide shafts, said longitudinal shutter having a shutter attachment extending from a first end of the longitudinal shutter for attachment to opposing edges of the longitudinal band.

12. The shutter mechanism of claim 11 wherein said shutter attachment further comprises a channel for sliding engagement with one of the drive shafts and the guide shafts.

13. The shutter mechanism of claim 11 wherein the guide shafts are orthogonal to the drive shafts to define said aperture.

14. The shutter mechanism of claim 11 wherein the transverse band slides about said aperture in a substantially rectangular path.

15. The shutter mechanism of claim 11 wherein the longitudinal band slides about said aperture in a substantially rectangular path.

16. The shutter mechanism of claim 11 wherein the cams are on the drive shafts.

* * * * *